US006345161B2

(12) United States Patent
Mizuno

(10) Patent No.: US 6,345,161 B2
(45) Date of Patent: Feb. 5, 2002

(54) NON-CONTACT DEVELOPING METHOD, NON-CONTACT DEVELOPING DEVICE AND IMAGE FORMATION DEVICE

(75) Inventor: Tsuneo Mizuno, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/748,011

(22) Filed: Dec. 27, 2000

(30) Foreign Application Priority Data

Feb. 29, 2000 (JP) ..... 2000-054144

(51) Int. Cl.[7] ..... G03G 15/06; G03G 15/08

(52) U.S. Cl. ..... 399/55; 399/285; 399/289; 430/120

(58) Field of Search ..... 399/285, 289, 399/53, 55; 430/120

(56) References Cited

U.S. PATENT DOCUMENTS 5,557,392 A * 9/1996 Iwata ..... 399/285 X
5,860,040 A * 1/1999 Shimizu et al. ..... 399/55
5,997,772 A * 12/1999 Cornelius et al.

FOREIGN PATENT DOCUMENTS

JP 61-172175 * 8/1986
JP 61-226775 * 10/1986
JP 11-73008 3/1999

* cited by examiner

*Primary Examiner*—Susan S. Y. Lee
(74) *Attorney, Agent, or Firm*—Armstrong, Westerman, Hattori, McLeland & Naughton LLP

(57) ABSTRACT

This invention relates to a non-contact developing method for applying a driving voltage, which is an AC voltage superimposed on a DC offset voltage, to a non-contact developing roller to develop toner, and which prevents the selective developing phenomenon from occurring. The velocity ratio between the flying velocity of toner with a large particle size and the flying velocity of toner with a small particle size changes according to the driving frequency f of the AC voltage (45) applied to the developing roller, so by setting the driving frequency f of the AC component within a range where selective developing of the toner does not occur, it is possible to effectively prevent the selective developing phenomenon from occurring.

16 Claims, 13 Drawing Sheets

NON-CONTACT DEVELOPING METHOD, NON-CONTACT DEVELOPING DEVICE AND IMAGE FORMATION DEVICE

BACKGROUND OF THE INVENTION

1. Field of the Invention

This invention relates to a non-contact developing method for forming a toner image on a latent image element such as a photosensitive drum, and to that developing device and image formation device, and more particularly to a non-contact developing method, image developing device and image formation device which applies a superimposed DC and AC voltage as a developing bias voltage, to fly the toner and to form a latent image on the latent image element.

2. Description of the Related Art

In recent years, electronic photographic equipment, and particularly electronic photograph printers are desired that are fast and capable of high image quality. Therefore, a non-contact developing method has been proposed. A non-contact developing method maintains a non-contact state between the photosensitive drum and the developing roller of the developing unit, while causing the toner on the developing roller to fly to the photosensitive drum to develop the static-electrical latent image on the photosensitive drum.

In order to develop an image in a non-contact state, it is necessary to make the toner on the developing roller to fly to the photosensitive drum. In order to do this, a bias voltage is applied between the developing roller and the photosensitive drum. The applied voltage is a voltage having an AC voltage superimposed on the DC offset voltage. By applying this voltage, the toner vibrates between photosensitive drum and developing roller and adheres to the latent image on the photosensitive drum to develop the image.

This method is a non-contact method, so it is possible to speed up the image-formation process, and it is possible to prevent the developing agent on the developing roller from damaging the toner image on the photosensitive drum, thus high-speed printing with high image quality is possible. This method of applying a AC electric field has been disclosed in Japanese Unexamined Published patents No. H6-19213, H7-72699, and H7-114223.

However, there is a problem that when an AC electric field having a frequency as proposed by the prior art (for example 6000 Hz) is applied, the image quality is good during the first printing, however the image quality decreases as printing continues. In other words, the particle size of the toner of the developer is not uniform and is somewhat distributed. Generally, for toner having a large particle size, the amount of charge is low, and for toner having a small particle size, the amount of charge is high.

The Coulomb force F for the electric field E in the space between the developing roller and the photosensitive drum is $F=qE$, so it becomes easier for highly charged small toner particles to fly to the photosensitive drum. Therefore, the smaller the particle size of the toner is, the faster the toner of the developer is consumed, and the large particle sized toner remains. Therefore, as the number of prints to be made increases, the particle size of the toner used for developing becomes larger. This is called the selective developing phenomenon. Since the resolution drops as the quantity of printing increases, there is the problem that the image quality decreases.

In order to prevent the selective developing phenomenon, it is necessary to make sure the particle size of the toner that is put into the developing unit is uniform. However, it is difficult to find toner with a uniform particle size. Especially, with the recent improvement of image quality, the average particle size is 10 microns or less. It is nearly impossible to make uniform toner with this kind of minute particle size.

SUMMARY OF THE INVENTION

The objective of this invention is to provide a non-contact developing method, a non-contact developing device and image-formation device that is capable of effectively preventing the selective developing phenomenon from occurring.

Another objective of this invention is to provide a non-contact developing method, a non-contact developing device and image-formation device that utilizes the flying characteristics of the toner to prevent the selective developing phenomenon from occurring.

A further objective of this invention is to provide a non-contact developing method, a non-contact developing device and image-formation device which pays attention to the fact that large particle sized toner does not lose its high speed due to air resistance, and effectively utilizes the flying characteristics of large particle sized toner to prevent the selective developing phenomenon from occurring.

Yet another objective of this invention is to provide a non-contact developing method, a non-contact developing device and image-formation device that prevents the selective developing phenomenon from occurring by setting the frequency of the AC component.

In order to achieve this objective, the non-contact developing method of this invention is a method of flying toner from the developer carrying unit to the latent image bearing element by applying a developing bias voltage with an AC component superimposed on a DC component to develop the static-electric latent image on the latent image bearing element. In addition, the frequency f of the AC component is set with in a range such that the selective developing of the toner does not occur.

The non-contact developing device of this invention comprises a developer carrying unit for carrying the toner, and means for applying a developing bias with an AC component superimposed on a DC component to the developer carrying unit, in order to fly the toner from the developer carrying unit to the latent-image bearing element to develop the static-electric latent image on the latent-image bearing element. In addition, the frequency f of the AC component is set with in a range such that the selective developing of the toner does not occur.

The image-formation device of this invention comprises a latent-image bearing element, a developer carrying unit for carrying the toner, and means for applying a developing bias with an AC component superimposed on a DC component to the developer carrying unit, to fly the toner from the developer carrying unit to the latent-image bearing element to develop the static-electric latent image on the latent-image element. In addition, the frequency f of the AC component is set with in a range such that the selective developing of the toner does not occur.

The inventors of this invention studied the relationship between the frequency of the AC component and the flying speed of the toner, and found that the flying speed of the toner varied according to the particle size of the toner. It was found that when the flying speed of toner with a large particle size becomes faster than the flying speed of toner with a small particle size, it becomes easier for the large article sized toner with the small charged amount to fly and thus it is possible to prevent selective developing from occurring.

It was found that the ratio between the flying speed of toner having large-sized particles and that of toner having small-sized particles changes according to the frequency of the AC voltage, so by setting the frequency 'f' of the AC component with in a range such that selective developing of the toner does not occur, it is possible to effectively prevent the selective developing phenomenon from occurring. Only the frequency 'f' of the AC component needs to be set, so the selective developing phenomenon can be prevented without having to adjust the particle size of the developing agent.

In another form of the non-contact developing method of this invention, the frequency range is $5\times10^{*}v<=f<=1.36^{*}\eta/(r^{2*}\delta)$. Here, v is the process velocity of the latent image bearing element, r is the radius of the toner particles, n is the viscous resistance of air, and δ is the density of the toner particles.

In this form of the invention, the upper limit of the frequency is set such that the velocity ratio between the flying speed of toner with large-sized particles and the flying speed of toner with small-sized particles is a fixed value or greater, and the lower limit is set in a range such that no variation in print density occurs. Therefore, no variation in print density occurs and it is possible to prevent selective developing from occurring.

In the non-contact developing method of another form of the invention, the frequency 'f' of the AC component is set such that the velocity ratio of toner with a particle size that is 1.5 times that of the average particle size, is 1.1 times or more with respect to toner with an average particle size.

In this form of the invention, the particle size distribution of normal toner is within the range of about 1.5 times that of the average particle size, so with a velocity ratio of this toner having 1.5 times particle size with the average particle size 1.1 times or more, it is possible to effectively prevent selective developing from occurring.

In the non-contact developing method of yet another form of the invention, the frequency 'f' of the AC component is set such that the amount of movement of latent-image bearing element during one cycle of the AC component is 0.2 mm or less.

In this form of the invention, when one cycle of the AC component is long (in other words, when the frequency is low), variation in print density occurs, so the lower limit is set such that no variation in print density occurs. Therefore, it is possible to prevent selective developing from occurring without the occurrence of variation in density.

DESCRIPTION OF THE PREFERRED EMBODIMENTS

The embodiments of this invention will be explained below in the order of the image-formation device, developing method, example, and another embodiment.

Image-formation Device

Figure 1:
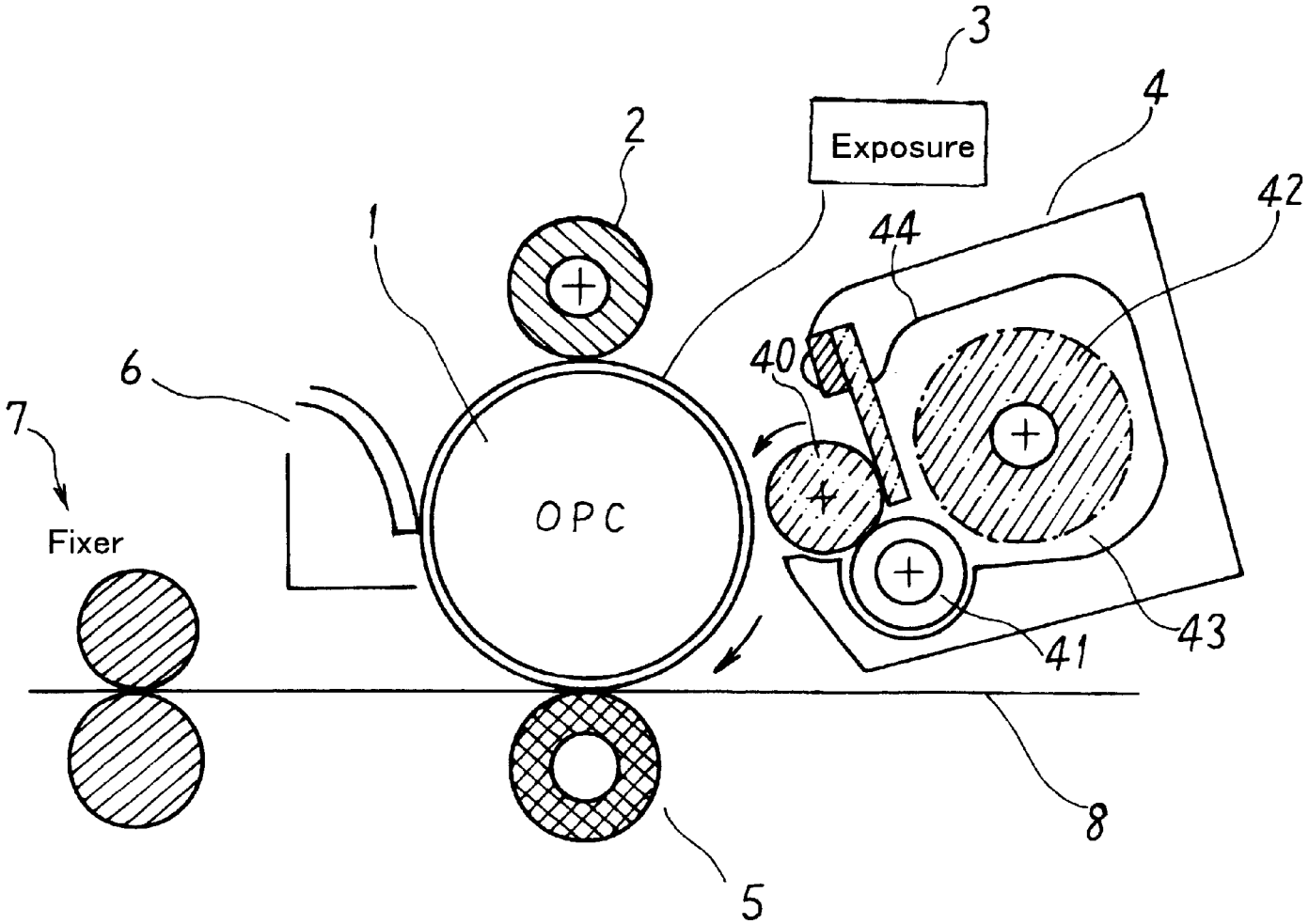
FIG. 1 is a schematic drawing of an image-formation device of an embodiment of the invention.
Figure 2:
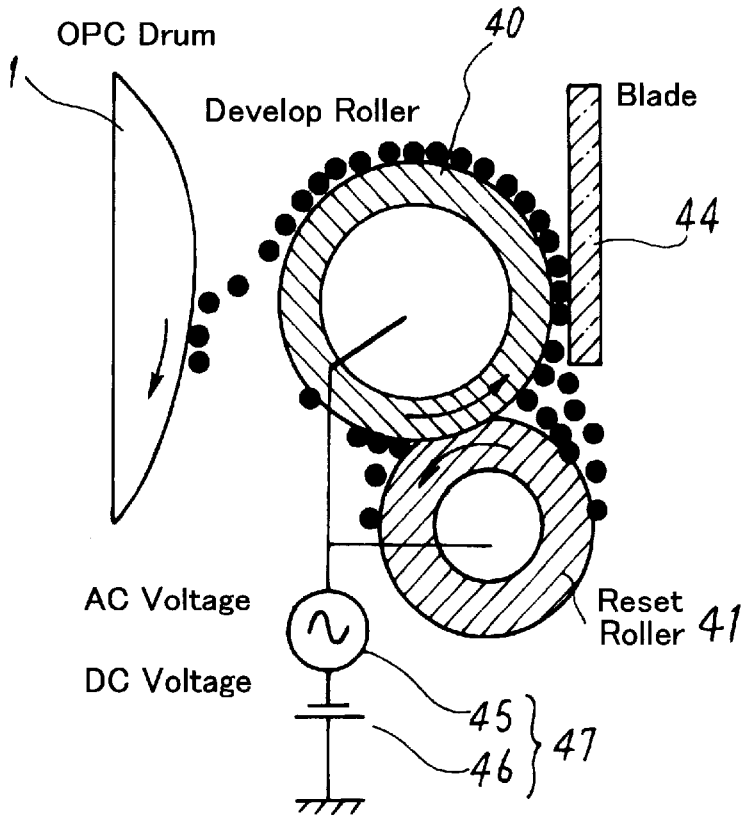
FIG. 2 is an enlarged view of the developing device in FIG. 1.

FIG. 1 is a schematic drawing of an image-formation device of one embodiment of the invention, and FIG. 2 is an enlarged view of the developing device. FIG. 1 shows an electronic photographic printer as the image-formation device.

As shown in FIG. 1, the electronic photographic device comprises a photosensitive drum 1 as the latent-image bearing element. The photosensitive drum 1 is an OPC drum, having for example, a dark-area potential of −700V ±20V, and light-area potential of −80V±10V. The charging unit 2 comprises an electric-charge brush that uniformly charges the photosensitive drum 1. The electric-charge brush 2 is formed from conductive rayon, or the like. The applied voltage is AC voltage that is superimposed with a DC offset voltage. A light image exposure unit 3 exposes the photosensitive drum 1 with a light image, and forms a static-electric latent image on the photosensitive drum 1. For example, it is possible to use an LED array.

A non-contact developing device 4 develops the static-electric latent image on the photosensitive drum 1 with toner. This developing device 4 is a single-component developing unit. A developing roller 40 does not come in contact with the photosensitive drum 1, but carry toner 43 to the photosensitive drum 1. The developing roller 40 is made of aluminum, for example, and in order to carry the toner 42, its surface is blast treated.

As shown in FIG. 2, a reset roller 41 rotates in the same direction as the developing roller 40 and removes toner from the developing roller 40. The reset roller 41 is made of urethane resin. A blade 44 made of stainless steel, regulates the thickness of the toner layer on the developing roller 40 to a set value.

A paddle roller 42 mixes the toner 43 inside the developing unit 4 to electrically charge the toner 43. The toner 43 is polyester resin containing coloring agent, for example, and added with a conducting agent and silica.

A transfer unit 5 comprises a transfer roller. The transfer roller is made of polyurethane foam and is driven by a constant current. The transfer roller 5 transfers the toner image on the photosensitive drum 1 to a medium 8. A cleaner 6 removes the residual toner from the photosensitive drum 1. A fixing unit 7 thermal fixes the toner image to the medium 8.

As shown in FIG. 2, the developing roller 40 does not come in contact with the photosensitive drum 1. The direction of rotation of the developing roller 40 is opposite the direction of rotation of the photosensitive drum 1, and is so-called 'with' rotation. The direction of rotation of the reset roller 41 is the same as the direction of rotation of the developing roller 40, and is so-called 'counter' rotation.

A developing bias voltage is applied to the developing roller 40 and reset roller 41 from a developing bias power supply 47. The developing bias power supply 47 connects the DC voltage supply 46 and AC voltage supply 45 in series, and applies a DC offset voltage, containing an AC voltage, to the developing roller 40.

By applying this AC voltage, the toner 43 on the developing roller 40 vibrates and becomes in a state where it is easy for it to fly, and with the DC offset voltage, it flies in the direction of the photosensitive drum 1. In this way, the static-electric latent image on the photosensitive drum 1 is developed. As described above, toner having a large amount of electric charge has a strong Coulomb force with respect to the electric field of the space, so it easy for toner having a small particle size and large electric charge to adhere to the photosensitive drum 1. Therefore, the selective developing phenomenon occurs.

This invention takes advantage of the flying characteristics of toner having a large particle size to strain this selective developing. That developing method will be explained below.

Developing Method

Figure 3:
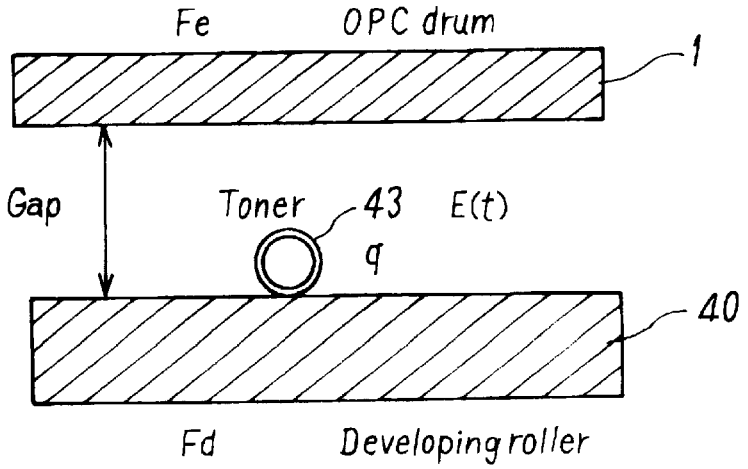
FIG. 3 is a model diagram of the non-contact developing in FIG. 2.

FIG. 3 is a model diagram of the non-contact developing of an embodiment of this invention. The developing unit is modeled in order to analyze the effect of the toner on non-contact developing.

First, the equations of motion for the toner will be found. As shown in FIG. 3, 'm' is the mass of one particle of toner, 'a' is the acceleration, 'F' is the dynamic force applied to the toner, 't' is time, 'v(t)' is the velocity of the toner particle, 'π' is circular constant, 'n' is the viscous resistance of air, 'r' is the radius of the toner particle, 'q' is the amount of electric charge on the toner particle, and 'r' is the radius of the toner particle. Also, '∈0' is the dielectric constant of air, and '∈t' is the dielectric constant of the toner, and '∈d' is the dielectric constant of the OPC drum 1.

From the laws of Newton, the dynamic force 'f' acting on the toner particles in air is given by equation (1) below.

$$F=ma+6\pi\eta rv(t) \tag{1}$$

Moreover, from Coulomb's law, the electrically applied force 'F' that is applied is given by equation (2) below.

$$F=qE(t) \tag{2}$$

Where E(t) is the electric field strength of the space.

Furthermore, the image force for the toner to adhere is considered. The image force 'fa' for the toner to adhere to the developing roller 40 is given by equation (3) below.

$$fa=q^2/4\pi\in t\in 0\ (2r)^2 \tag{3}$$

Also, the image force 'fd' for the toner to adhere to the OPC drum 1 is given by equation (4) below.

$$fd=q^2/4\pi\in 0\ (2r+2d/\in d)^2 \tag{4}$$

The equation of motion for when the toner flies within the air from the developing roller is given in equation (5) below.

$$ma=qE-6\pi\eta v(t)-fa \tag{5}$$

The equation of motion for when the toner flies within the air from the OPC drum is given in equation (6) below.

$$ma=qE-6\pi\eta v(t)-fd \tag{6}$$

Here, the space is sufficiently large for the particle size of the toner, so the image forces 'fa', 'fd' can be ignored during flight. Accordingly, equations (5) and (6) can be expressed by equation (7) below.

$$m\ d/dt\ v(t)+6\pi\eta v(t)-qE(t)=0 \tag{7}$$

Both sides of equation (7) are transformed into 's' area by the Laplace transform. Here, V(s) and E(s) are defined by equations (8) and (9) below.

$$V(s)=\int_0^\infty v(t)e^{-st}dt \tag{8}$$

$$E(s)=\int_0^\infty E(t)e^{-st}dt \tag{9}$$

Accordingly, the Laplace transform equation is shown in equation (10) below.

$$\int_0^\infty m\left\{\frac{d}{dt}v(t)\right\}e^{-st}dt+\int_0^\infty 6\pi\eta rv(t)e^{-st}dt-\int_0^\infty qE(t)e^{-st}dt=0 \tag{10}$$

Here, when the initial velocity of the toner particle is taken to be v(0)=0, equation (10) changes to equation (11) below.

$$msV(s)+mv(0)+6\pi\eta rV(s)-qE(s)=0 \tag{11}$$

Accordingly, V(s) is obtained from equation (12) below.

$$V(s)=qE(s)/(ms+6\pi\eta r) \tag{12}$$

Here, when H(s) is defined by equation (13) below, equation (12) changes to equation (14).

$$H(s)=1/(s+6\pi\eta(r/m)) \tag{13}$$

$$V(s)=(q/m)\ H(s)\ E(s) \tag{14}$$

In equation (14), E(s) is the electrical characteristic, so H(s) shows the flying characteristics in air with respect to velocity of the toner particle.

Here, s=jω, so when finding the absolute value |H(Jω)| in the complex function region (s region) from equation (13), the frequency characteristics of the toner are obtained in equation (15)

$$|H(j\bar{\omega})|=\frac{1}{\sqrt{\bar{\omega}^2+\{6\pi\eta(r/m)\}^2}} \tag{15}$$

By taking 'f' to be the frequency of the AC voltage that is applied, then ω=2πf, so when inserting the values for the viscosity of air $n=1.82\times10^{-5}$ kg/m*s and mass of the toner $m=(4/3)\pi r^3\times1100$ kg/m$^3$ (where 1100 kg/m$^3$ is the density of the toner) into equation(15), then from equation (14) the relationship between the particle size and the frequency of the AC component is simulated. The results are shown in FIG. 4 and FIG. 5.

Figure 4:
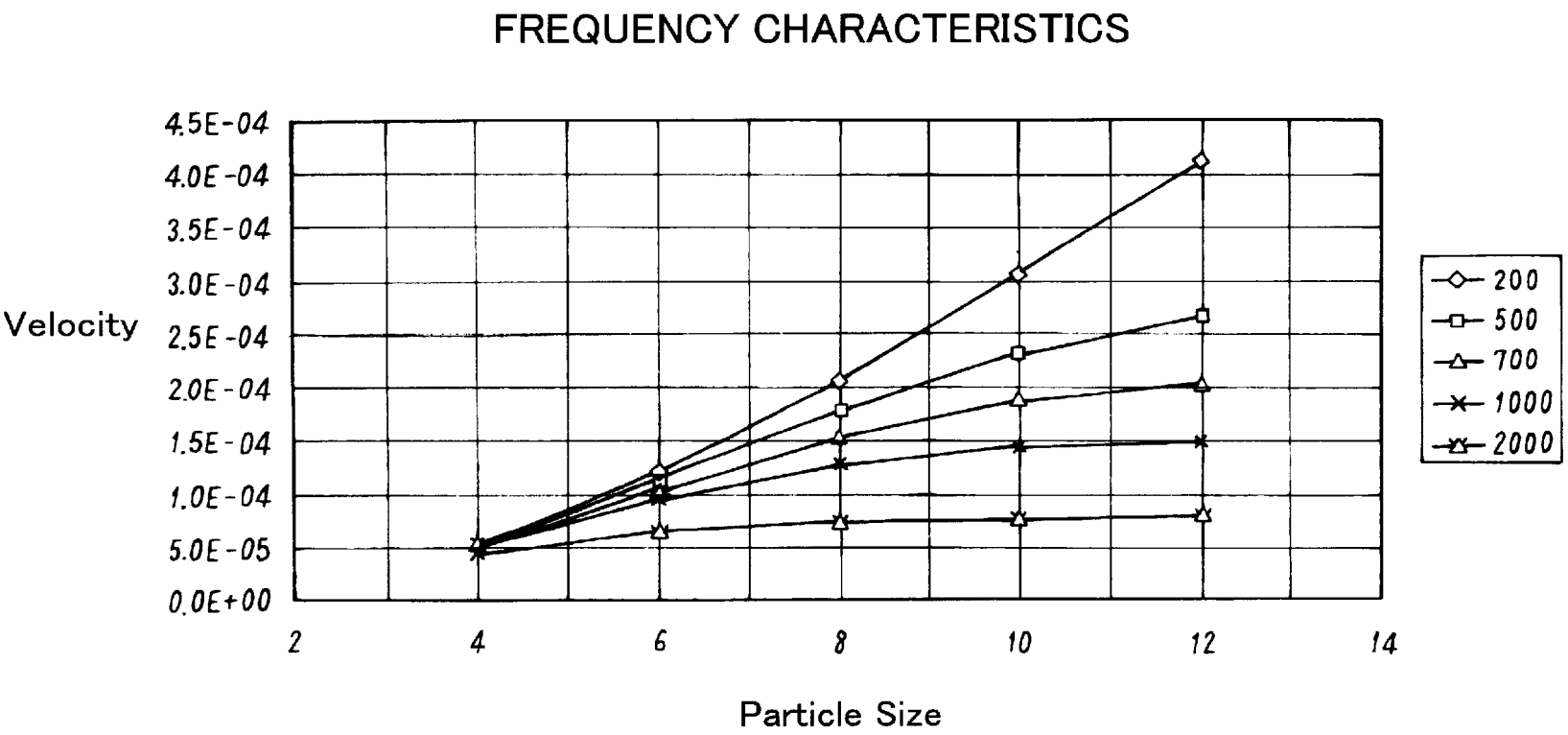
FIG. 4 is a drawing showing the relationship between the particle size of the toner and the flying speed in order to explain the invention.

In FIG. 4, the particle size d of the toner (d=2r) is shown along the horizontal axis, and the particle velocity is shown along the vertical axis. The characteristics are shown for the frequencies; 200 Hz, 500 Hz, 700 Hz, 1000 Hz, and 2000

Hz. In FIG. 5, the frequency (Hz) of the AC component is shown along the horizontal axis, and the particle velocity is shown along the vertical axis. The characteristics are shown for particle sizes of the toner; 12 μm, 10 μm, 8 μm, 6 μm and 4 μm.

Figure 5:
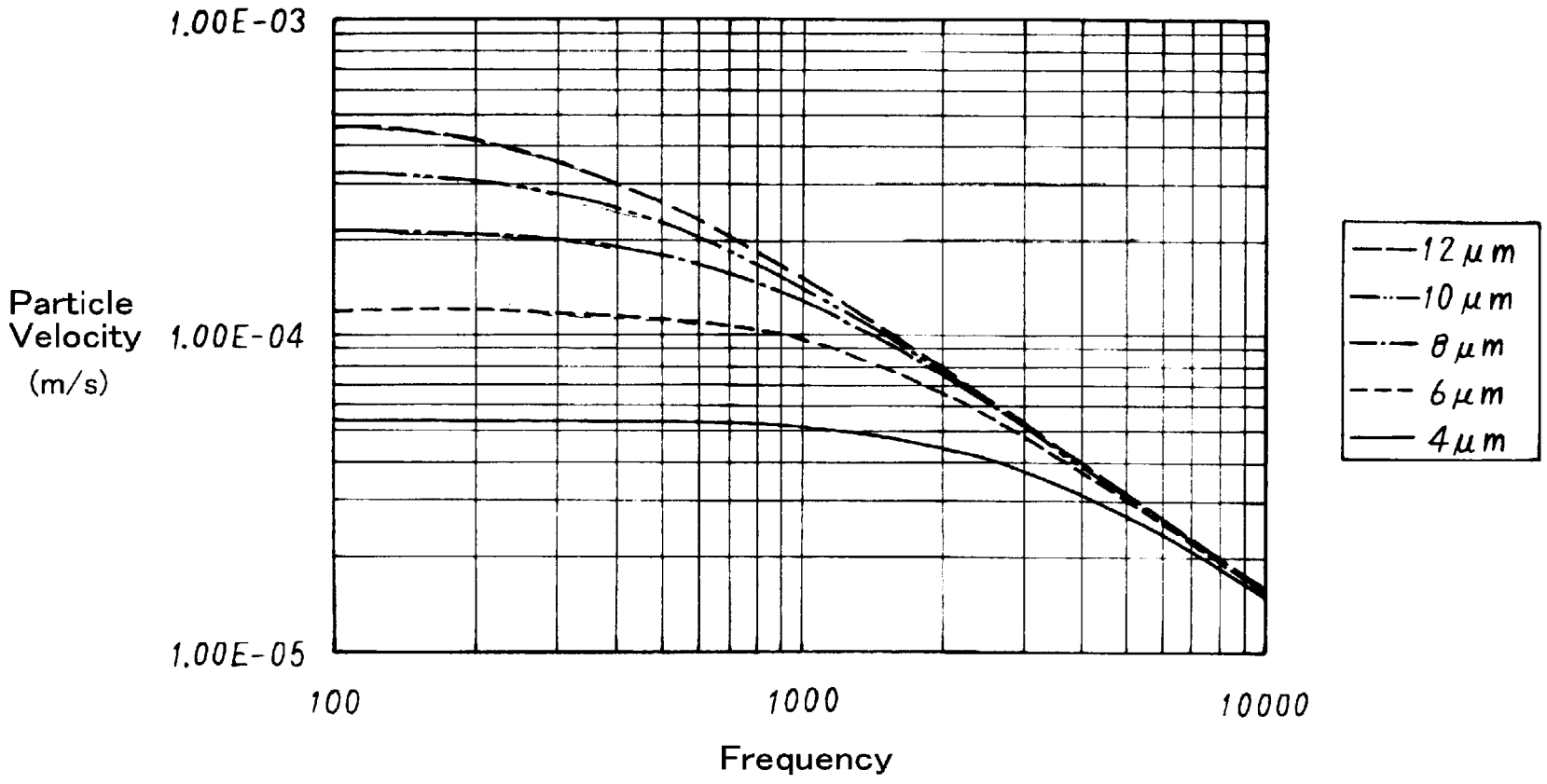
FIG. 5 is a drawing showing the relationship between the AC frequency and the particle velocity in order to explain the invention.

From FIG. 4 and FIG. 5 it can be seen that at the same frequency, the flying velocity of the toner and the ease at which the toner flies increases as the particle size of the toner increases. Also, this tendency becomes more notable as the frequency becomes lower. From this result, it can be seen that by selecting a suitable AC driving frequency, it is possible even for toner with a large particle size and small electric charge to fly as well as toner with a small particle size and large electric charge. In other words, by selecting the driving frequency, it is possible to prevent selective developing from occurring.

Figure 6:
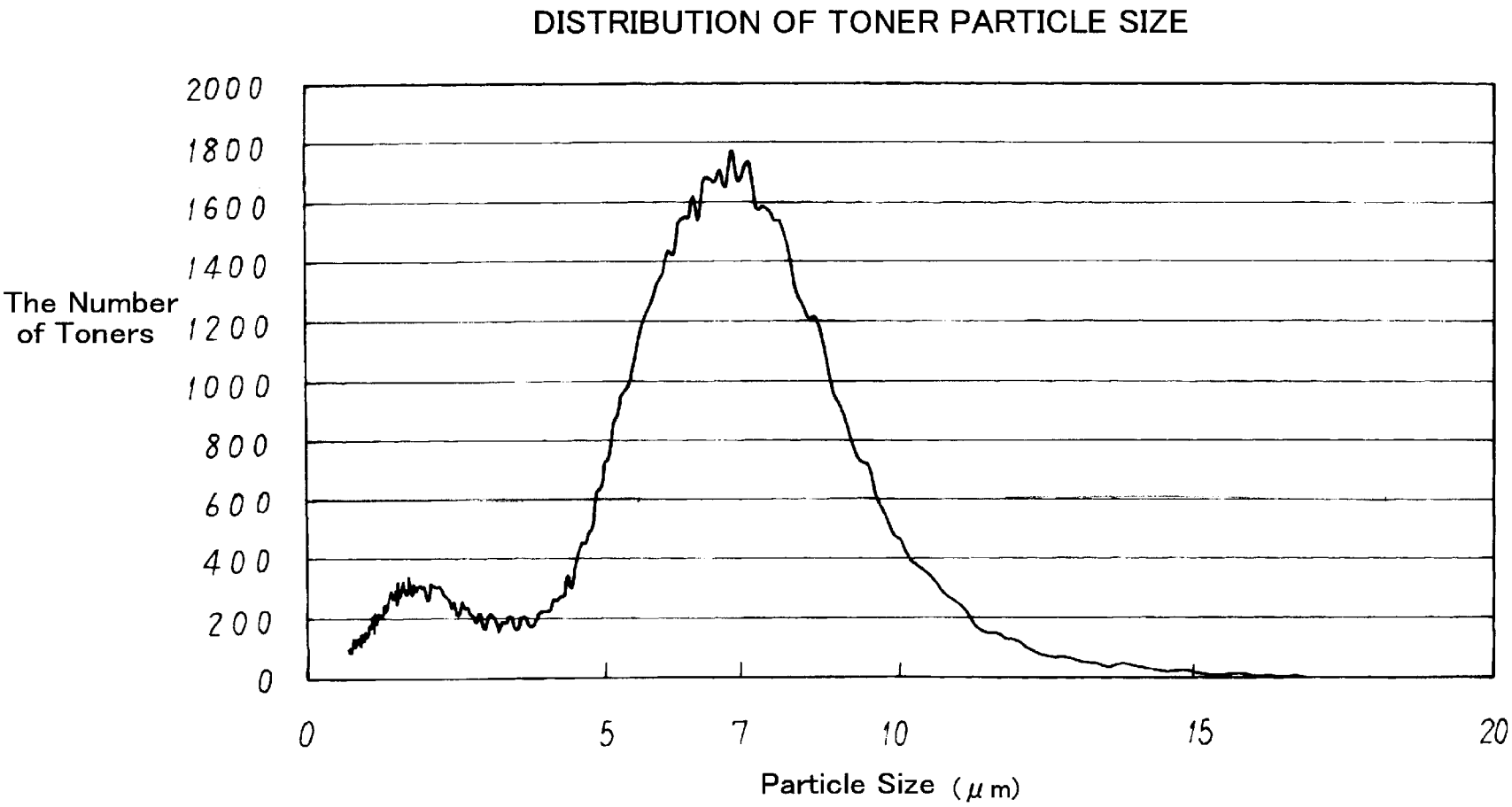
FIG. 6 is a drawing showing the distribution in toner particle size in order to explain the invention.

Next, the conditions for this driving frequency will be explained. FIG. 6 shows the distribution of toner particle size. AS shown in FIG. 6, when investigating commercially sold toner for the distribution of the number of toner particles with an average particle size of 7 um, most of the toner is in the range from 5 um to 10 um. The distribution of the number of particles of toner was measured with a call counter.

Therefore, of the toner in the developing unit, the maximum particle size of the consumed toner can be considered to be approximately 1.5 times (10/7) the average particle size.

Figure 7:
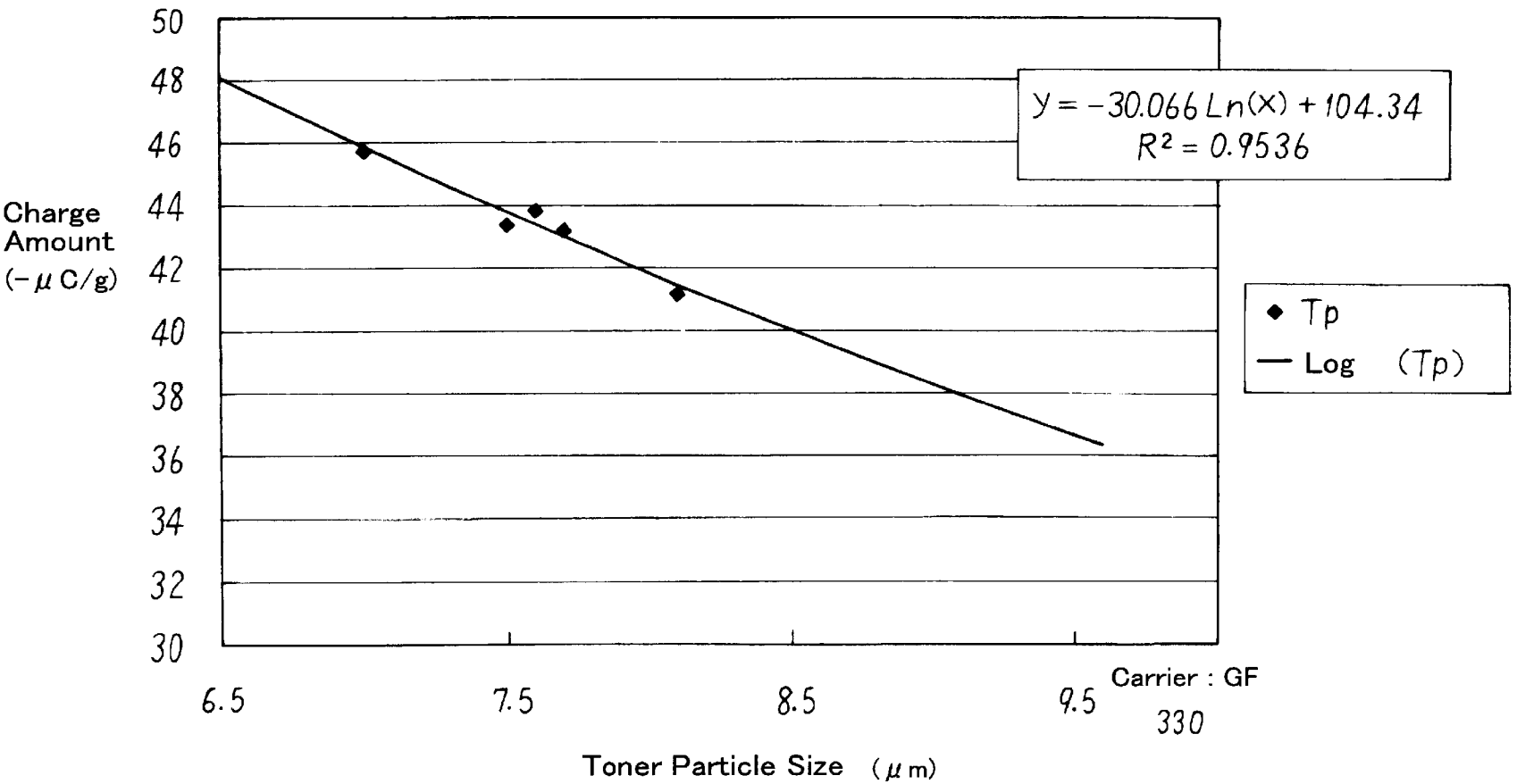
FIG. 7 is a drawing explaining the dependency of the amount of charge on the particle size in order to explain the invention.

FIG. 7 shows the relationship between the particle size of the toner and the electric charge on the toner of that size. As shown in FIG. 7, as the particle size of the toner increases, the electric charge on the toner decreases. From this difference in the amount of electric charge, it becomes difficult for toner having a large particle size to fly, and the problem of selective developing occurs. Particularly, in a color electronic photographic with overlapping colored toners, the particle sizes of the colored toners on the medium vary and the quality of the color image decreases.

From the distribution of toner particle size shown in FIG. 6, is can be seen that it is possible to prevent the occurrence of the selective developing phenomenon, by making the flying velocity of toner with a particle size that is approximately 1.5 larger than the average particle size faster than the flying velocity of toner with average particle size. From FIG. 4 and FIG. 5, it can be seen that it is possible to satisfy this condition by selecting the proper AC frequency.

From equations (14) and (15) above, the flying characteristic of the toner is defined by $|H(j\omega)|$, so when the toner density is taken to be δ, the frequency characteristic $|H(j\omega)|1$ for an average particle size d=2r is given by equation (16) below.

$$|H(j\omega)|1=1/\mathrm{SQRT}(\omega^2+(4.5\eta/(r^2*\delta)^2) \quad (16)$$

Similarly, for a particle size that is 1.5 times the average particle size d (d=3r),the frequency characteristic $|H(j\omega)|2$ is given by equation (17) below.

$$|H(j\omega)|2=1/\mathrm{SQRT}(\omega^2+(2\eta/(r^2*\delta)^2) \quad (17)$$

Figure 8:
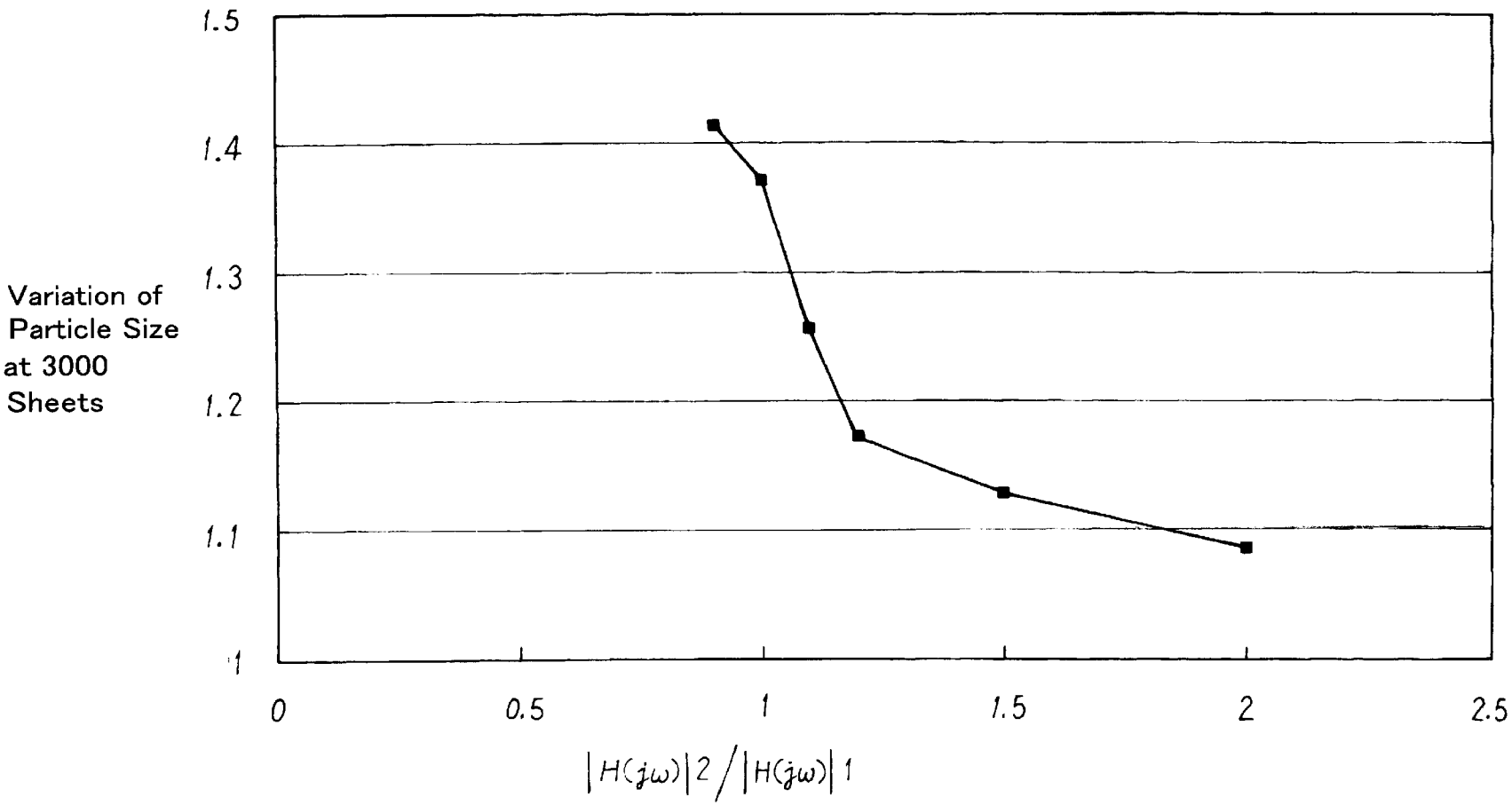
FIG. 8 is a drawing showing the relationship between the flying characteristics and change in particle size in this invention.

For the ratio of frequency characteristics $|H(j\omega)|2/|H(j\omega)|1$, the change in particle size for 3000 sheets is shown in FIG. 8. In FIG. 8, the aforementioned ratio is along the horizontal axis, and the ratio of the average particle size of the toner after 3000 sheets to the initial average particle size is along the vertical axis. Measurement of the average particle size was performed by measuring the toner on the developing roller with a call counter. As can be seen from FIG. 8, when the ratio is 1.1 or greater, the change in particle size is 1.2 or less, and this change is in the range that will cause no problem. On the other hand, when the ratio is less than 1.1, the change in particle size suddenly increases. Therefore, a ratio of 1.1 or greater is good.

When the AC frequency is selected such that equation (18) below is satisfied, it is possible to prevent selective developing.

$$|H(j\omega)|2/|H(j\omega|1\geqq 1.1 \quad (18)$$

In other words, the velocity ratio of toner with a particle size that is 1.5 times the average particle size with respect to toner with average toner size, should be 1.1 or greater. By substituting this into equations (18), (16) and (17), to find the range of frequency 'f', a frequency range equation (19) is obtained.

$$f\leqq 1.36\eta/(r^2*\delta) \quad (19)$$

The upper frequency limit for preventing selective developing is defined by this. Next the lower AC frequency limit will be considered. When the frequency is low, white lines (horizontal lines) occur in developing during fully black printing. Therefore, the lower frequency limit is set to a level where these white lines (horizontal lines) that occur in developing during fully black printing are not noticeable.

When the process velocity (drum velocity) of the photosensitive drum 1 is taken to be 'v', and the amount of drum movement during one cycle of the AC component of the developing bias is taken to be '1', then equation (20) below is obtained.

$$l=v/f \quad (20)$$

Figure 9:
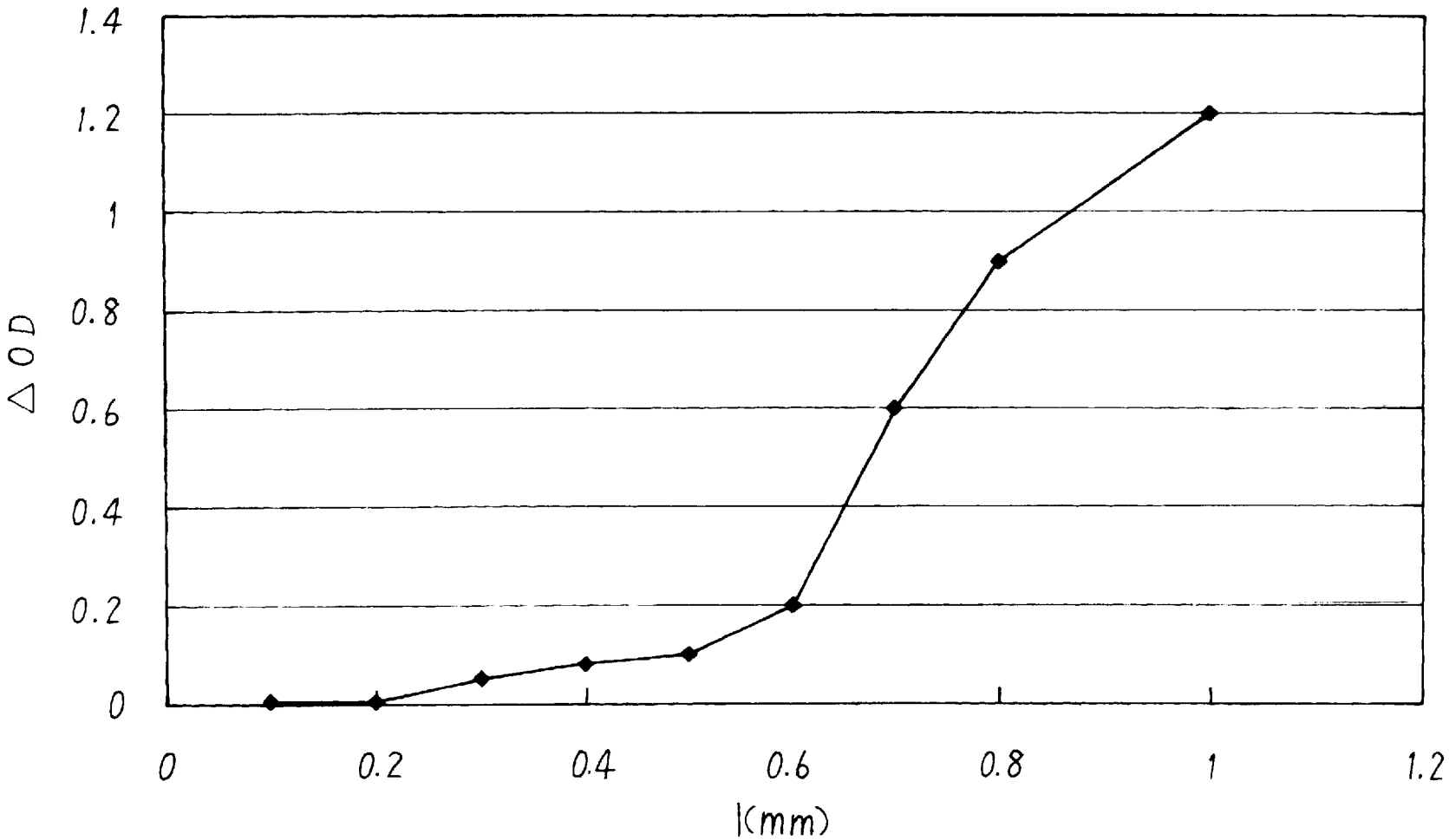
FIG. 9 is a drawing showing the relationship between the AC frequency and variation in print density in this invention.

Developing (fully black printing) was performed while changing the value for '1', and the print density variation (ΔOD) was measured with a densitometer. FIG. 9 shows the results in a graph, where '1' is along the horizontal axis, and ΔOD is along the vertical axis. From the test results in FIG. 9, it can be seen that variation in the print density does not occur when '1' is 0.2 mm or less. When '1' is 0.5 mm or more, density variations occur in the fully black printing area, and as '1' becomes shorter, the density variations decrease, and when '1' is 0.2 mm or less, uniform density with no density variation is obtained.

Form equation (20) and the condition $1\leqq 0.2$ mm, the lower frequency limit is given by equation (21) below.

$$f>5\times 10^{-4}v \quad (21)$$

By using the flying characteristics of toner with large particle size in this way, it is possible to prevent the selective developing phenomenon from occurring. Therefore, it is also possible to prevent changes in resolution as the number of prints increases, and uniform image quality becomes possible. Moreover, it is possible to prevent variation in density. Furthermore, since it is possible to select the AC frequency, it can be performed easily with a low case.

Figure 10:
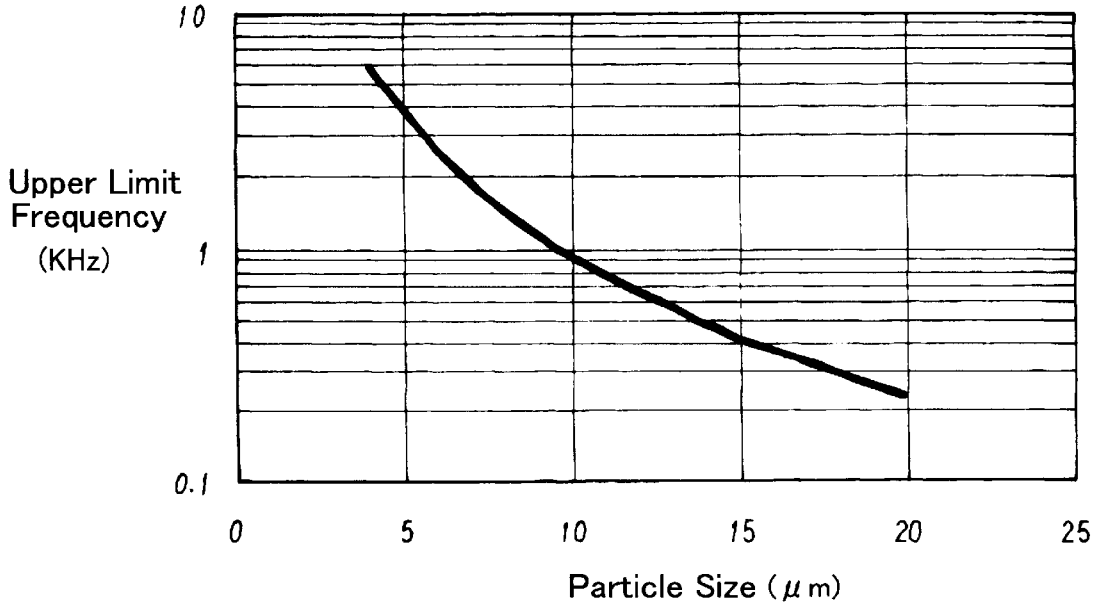
FIG. 10 is a drawing showing the relationship between the particle size and upper frequency limit in this invention.
Figure 11:
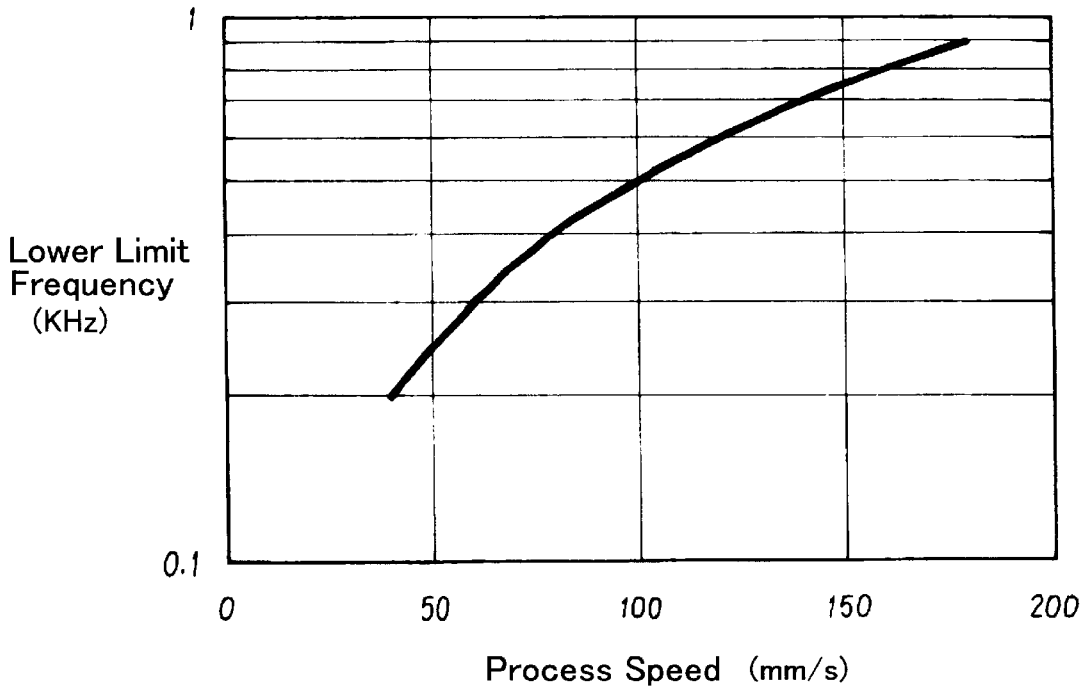
FIG. 11 is a drawing showing the relationship between the process speed and the lower frequency limit in this invention.

FIG. 10 shows the relationship between the particle size '2r ' obtained from equation (19) above and the upper frequency limit. From FIG. 10 it can be seen that as the particle size becomes smaller, the upper frequency limit becomes higher. FIG. 11 shows the relationship between the process speed obtained from equation (21) above and the lower frequency limit. From FIG. 11 it can be seen that as the process speed becomes faster, the lower frequency limit becomes higher.

From the particle size of the toner and the process speed, it is possible to select an AC frequency at which selective developing does not occur.

EXAMPLE

Figure 12:
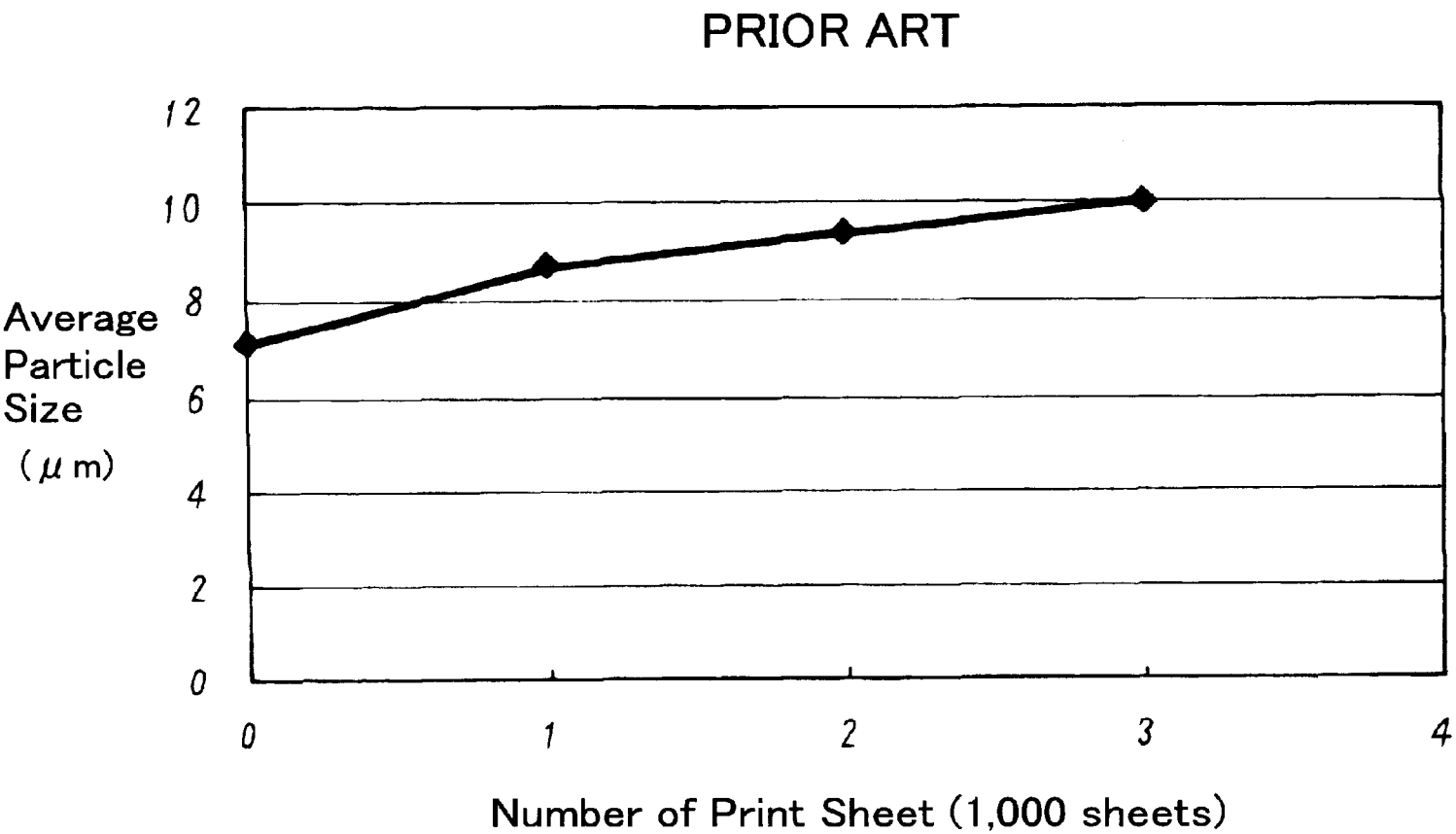
FIG. 12 is a drawing explaining a comparative example for this invention.

Next, and example will be explained. Polyester resin toner with an average particle size of 7.1 μm is put into the printing device shown in FIG. 1 and printing is performed. After every 1000 printed sheets, the toner used in developing is removed, and the average particle size is measured. FIG. 12 shows the characteristics of a prior example, where the driving frequency of the AC voltage is 2000 Hz, the duty is 35% (time that the toner flies to the drum), the driving waveform is a square wave, ACp-p (peak-to-peak) is 2.4 kV, the DC offset voltage is −500V, and the gap between the drum and developing roller is 300 μm.

Under the conditions above, the change in toner particle size when 5% print running was performed is shown in FIG. 12. Initially, the average particle size was 7.1 μm, and as the number of prints increased, it gradually became larger, and at 3000 prints, it was 10.1 μm. The average particle size is increase by 1.422 times, and selective developing was seen.

Figure 13:
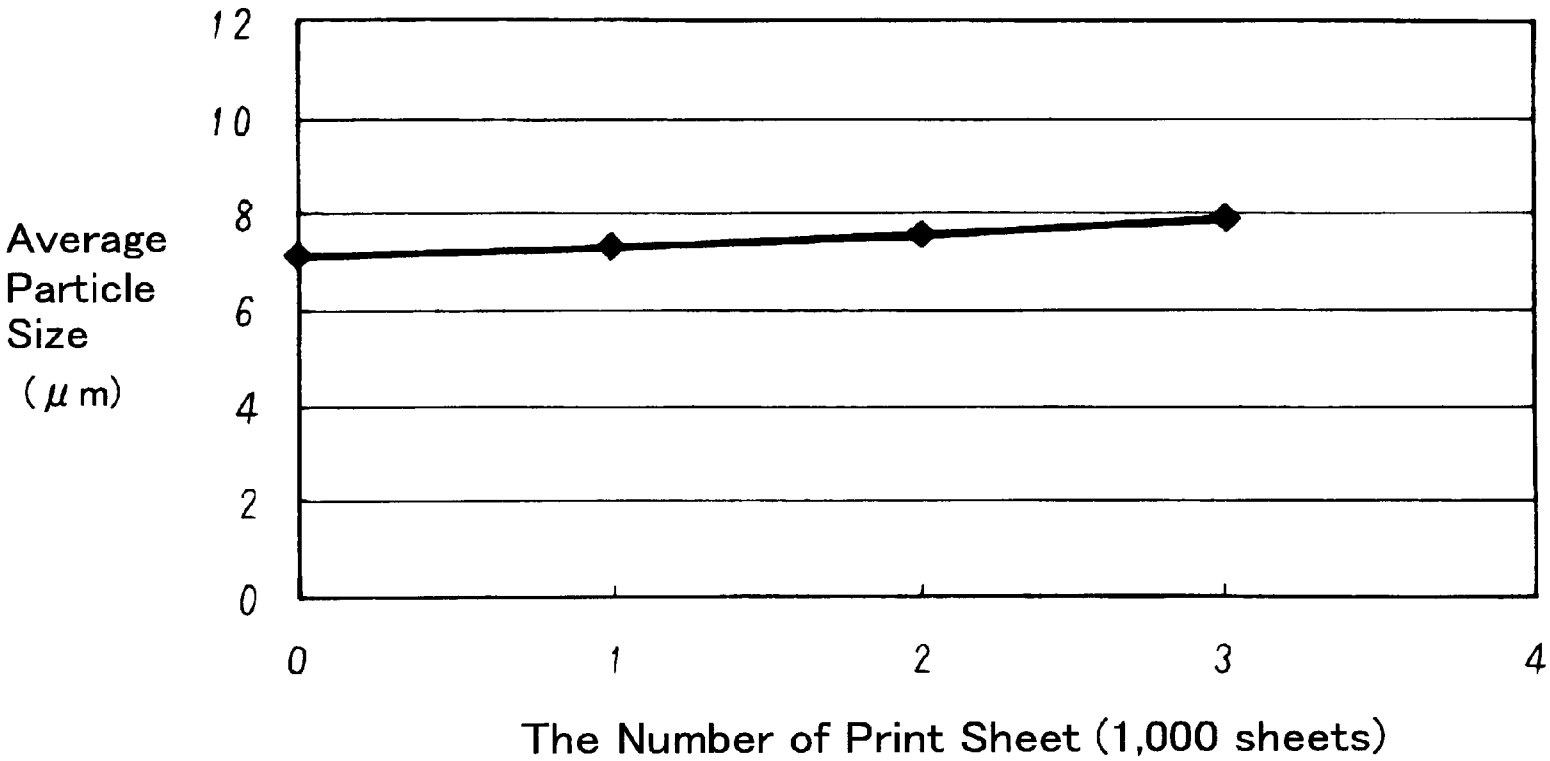
FIG. 13 is a drawing explaining an embodiment of this invention.

FIG. 13 is an example using this invention, and with the conditions described above, the driving frequency of the AC voltage is taken to be 800 Hz. The average particle size of the toner was 7.1 μm, and even after 3000 prints it was 7.9 μm, and thus selective developing was effectively prevented.

Another Embodiment

Figure 14:
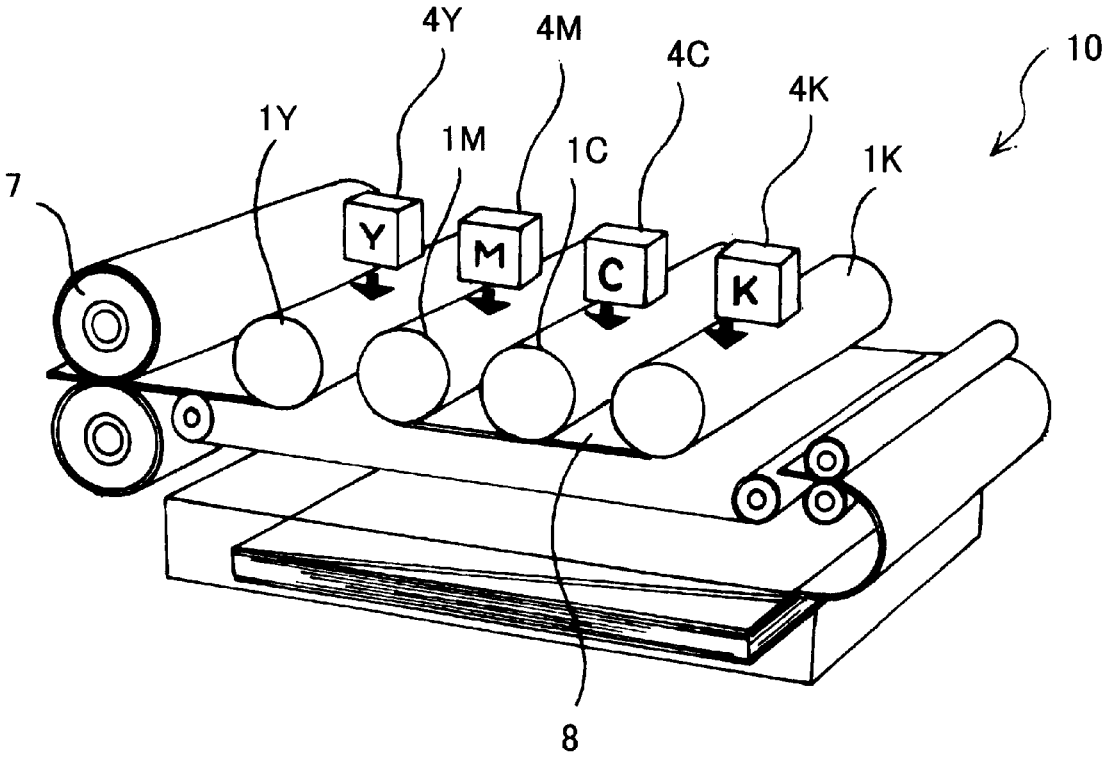
FIG. 14 is a schematic drawing of an another embodiment of this invention.

FIG. 14 is a schematic view of another embodiment of the invention, and shows a color printer.

The embodiment described above, as shown in FIG. 1, was explained for a monochrome printing device. With this printer there is not change in resolution of the image due to the number of prints. In other words, a color printing device 10 has the advantage that it can execute printing with uniform resolution taking advantage of the particle size. When this developing method is applied to a color printing device 10, it further enhances the effect. In other words, as shown in FIG. 14, the color printing device 10 comprises a developing unit 4Y to 4K for each color. For example, it comprises developing units 4M, 4C, 4Y, 4K for the four colors magenta, cyan, yellow and black.

In the case of the color printing device 10, the amount of toner consumed of each color is not uniform. Therefore, the amount of toner of each color that is in the respective developing units vary. When selective developing occurs, the particle sizes of toner of each of the colors vary. Therefore, when mixing toners of different colors, a color different than what is expected may result. For example, the color obtained when magenta toner with a particle size of 7 μm is mixed with cyan toner with a particle size of 7 μm, is clearly different from the color obtained from mixing magenta toner with a particle size of 7 μm with cyan toner with a particle size of 10 μm.

By applying this invention to a color printing device that uses a plurality of colors of toner, it is possible to prevent changes in color as the number of prints increases.

Moreover, the use of 1-component developing agent was explained, however, the invention can also be applied to 2-component developing agent comprising toner and carrier.

The preferred embodiments of the present invention have been explained, however the invention is not limited to these embodiments and can be embodied in various forms within the scope of the present invention.

With this invention, the following effects are obtained:

(1) The flying velocity of toner with large particle size is made to be faster than the flying velocity of toner with small particle size, such that it is easy for toner with a small electric charge and large particle size to fly, thus making it possible to prevent selective developing.

(2) The ratio of the flying velocity of toner with large particle size to the flying velocity of toner with small particle size changes depending on the frequency of the AC voltage, so by setting the frequency 'f' of the AC component in a range where selective developing of the toner does not occur, it is possible to effectively prevent the selective developing phenomenon from occurring.

(3) Since only the frequency 'f' of the AC component needs to be set, there is no need to adjust the particle size of the developing agent, making it simple to prevent selective developing.

What is claimed is:

1. A non-contact developing method for developing an electrically static latent image on a latent image bearing body with toners, comprising;

a step of carrying said toners comprising a plurality different particle size toners to a gap between said latent image bearing body and a developer carrying means for carrying said toners; and a step of applying a developing bias voltage with an AC component superimposed on a DC component to said developer carrying means, a frequency f of said AC component is set within a range such that selective developing of said toners does not occur.

2. The non-contact developing method of claim 1 wherein;

said frequency of said AC component is set in the range such that a flying speed of relatively large particle sized toners is faster than a flying speed of relatively small particle sized toners.

3. The non-contact developing method of claim 2 wherein;

said frequency of said AC component is set in the range $$5\times10\cdot v\leqq f\leqq1.36\cdot\eta/(r^2\cdot\delta)$$

where v is a process velocity of said latent image bearing body, r is the radius of said toner particles, η is a viscous resistance of air, and δ is a density of said toner particles.

4. The non-contact developing method of claim 2 wherein;

the frequency of said AC component is set such that a velocity ratio, of toner with a particle size that is 1.5 times that of an average particle size, is 1.1 times or more with respect to said toner with an average particle size.

5. The non-contact developing method of claim 2 wherein;

the frequency of said AC component is set such that the amount of movement of said latent image bearing body during one cycle of said AC component is 0.2 mm or less.

6. A non-contact developing device comprising:

a developer carrying means for carrying toners comprising a plurality different particle size toners to a gap between a latent image bearing body and said developer carrying means, and means for applying a developing bias with an AC component superimposed on a DC component to said developer carrying means to develop a static-electric latent image on said latent image bearing body; and wherein a frequency f of said AC component is set in a range such that selective developing of said toners does not occur.

7. The non-contact developing device of claim 6 wherein;

said frequency of said AC component is set in the range such that a flying speed of relatively large particle sized toners is faster than a flying speed of relatively small particle sized toners.

8. The non-contact developing device of claim 7 wherein;

said frequency of said AC component is set in the range $$5\times10\cdot v\leqq f\leqq1.36\cdot\eta/(r^2\cdot\delta)$$

where v is a process velocity of said latent image bearing body, r is the radius of said toner particles, η is a viscous resistance of air, and δ is a density of said toner particles.

9. The non-contact developing device of claim 7 wherein;

the frequency of said AC component is set such that a velocity ratio, of toner with a particle size that is 1.5 times that of an average particle size, is 1.1 times or more with respect to said toner with an average particle size.

10. The non-contact developing device of claim 7 wherein;

the frequency of said AC component is set such that the amount of movement of said latent image bearing body during one cycle of said AC component is 0.2 mm or less.

11. An image-formation device comprising:

a latent image bearing body, a developer carrying means for carrying toners comprising a plurality different particle size toners to a gap between said latent image bearing body and said developer carrying means, and means for applying a developing bias with an AC component superimposed on a DC component to said developer carrying means to develop a static-electric latent image on said latent image bearing body; and wherein a frequency f of said AC component is set in a range such that selective developing of said toners does not occur.

12. The image-formation device of claim 11 wherein;

said frequency of said AC component is set in the range such that a flying speed of relatively large particle sized toners is faster than a flying speed of relatively small particle sized toners.

13. The image-formation device of claim 12 wherein;

said frequency of said AC component is set in the range $$5\times10\cdot v\leqq f\leqq1.36\cdot\eta/(r^2\cdot\delta)$$

where v is a process velocity of said latent image bearing body, r is the radius of said toner particles, η is a viscous resistance of air, and δ is the density of said toner particles.

14. The image-formation device of claim 12 wherein;

the frequency of said AC component is set such that a velocity ratio, of toner with a particle size that is 1.5 times that of an average particle size, is 1.1 times or more with respect to said toner with an average particle size.

15. The image-formation device of claim 12 wherein;

the frequency of said AC component is set such that the amount of movement of said latent image bearing body during one cycle of said AC component is 0.2 mm or less.

16. The image-formation device of claim 11 wherein;

said developer carrying means comprises a plural developer carrying element for which each carries different color toners to said latent image bearing body.

* * * * *